US008739750B2

(12) United States Patent
Geers et al.

(10) Patent No.: US 8,739,750 B2
(45) Date of Patent: Jun. 3, 2014

(54) MECHANICAL BUCKET TAPPET

(75) Inventors: Christian Geers, Fuerth (DE); Wolfgang Christgen, Seukendorf (DE); Manfred Straetz, Leesten (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 42 days.

(21) Appl. No.: 13/546,326

(22) Filed: Jul. 11, 2012

(65) Prior Publication Data

US 2013/0014716 A1 Jan. 17, 2013

(30) Foreign Application Priority Data

Jul. 14, 2011 (DE) ..... 10 2011 079 193

(51) Int. Cl.
*F01L 1/14* (2006.01)

(52) U.S. Cl.
USPC ..... 123/90.48; 123/90.52; 29/888.43

(58) Field of Classification Search
USPC ..... 123/90.48, 90.52, 90.59; 29/888.43
See application file for complete search history.

(56) References Cited

U.S. PATENT DOCUMENTS 5,003,940 A * 4/1991 Hixson ..... 123/90.54

FOREIGN PATENT DOCUMENTS

DE 19815790 12/1998
DE 10114073 9/2002

* cited by examiner

*Primary Examiner* — Zelalem Eshete
(74) *Attorney, Agent, or Firm* — Simpson & Simpson, PLLC

(57) ABSTRACT

A mechanical bucket tappet (1) for a valve driver of an internal combustion engine having a hollow cylinder-shaped wall (2) which is delimited at one frontal area (3) by a disk-like bottom (4) whose top side (5) is provided as a cam stop face and which comprises a central, funnel-like recess (6), wherein a dome-like one-piece catch (8) aligned with the recess (6) projects from a lower side (7) of the bottom (4), the underside (9) of said catch being used for putting on a valve stem and wherein the funnel-like recess (6) is sealed near or at the top side (5) of the bottom (4), so that the bottom (4) comprises a central encasement (10).

3 Claims, 1 Drawing Sheet

MECHANICAL BUCKET TAPPET

CROSS-REFERENCE TO RELATED APPLICATIONS

This application claims priority from German Patent Application No. 10 2011 079 193.0 filed Jul. 14, 2011, which application is incorporated herein by reference.

FIELD OF THE INVENTION

The invention relates to a mechanical bucket tappet for a valve driver of an internal combustion engine having a hollow cylinder-shaped wall which is delimited at one frontal area by a disk-like bottom whose top side is provided as a cam stop face and which comprises a central, funnel-like recess, wherein a dome-like one-piece catch aligned with the recess projects from a lower side of the bottom, the underside of said catch being used for putting on a valve stem.

BACKGROUND OF THE INVENTION

This kind of bucket tappet is disclosed in DE 101 14 073 A1. However, the extrusion embossing procedure used to manufacture the dome-like catch at the lower side of the bottom ultimately inevitably results in the formation of the funnel-like recess in the top side of the bottom starting from a certain catch size. Furthermore, the manufacture of the catch is well described in DE 198 15 790 B4. The recess according to the first mentioned DE 101 14 073 A1 is meant to serve as lubricant reservoir. However, it is inevitable that manufacturing residues such as grinding or polishing particles and dust accumulate in the recess. Consequently, the thorough cleaning (washing) of the recess is required in an extremely time-consuming, costly work step in order to ensure that the subsequent work steps associated with extremely high cleanness requirements, such as in particular the application of wear protection coats, can be performed smoothly and to prevent any interference with the cam stop face.

BRIEF SUMMARY OF THE INVENTION

The object of the invention is to create a bucket tappet in which the accumulation of unwanted deposits in the recess is prevented.

According to the invention, this object is solved in that the funnel-like recess is sealed near or at the top side of the bottom, so that the bottom comprises a central encasement.

Furthermore, a method for the manufacture of a bucket tappet is proposed.

Consequently, the disadvantages described above are remedied. The accumulation of unwanted particles in the recess which are difficult or expensive to remove can be prevented with the seal near the bottom, meaning that a standard washing procedure can be applied prior to coating the top side of the bottom. The procedures according to the invention also prove to make sense for cases in which no application of coats to the bottom is planned. The use of the procedures according to the invention may also be possible for hydraulic bucket tappets or pump tappets.

According to an embodiment of the invention, the recess can be sealed by necking its inner wall. For this purpose, a forming tool which is not described in more detail can be applied clamp- or jaw-like to the exterior shell of the catch.

Alternatively, the recess can also be sealed with a separate plug which either remains in the bucket tappet or is removed prior to the final installation, among other things to reduce weight or prevent it from falling out during operation.

BRIEF DESCRIPTION OF THE SEVERAL VIEWS OF THE DRAWING

The invention is explained based on the drawing. In the figures.

DETAILED DESCRIPTION OF THE INVENTION

Figure 1:
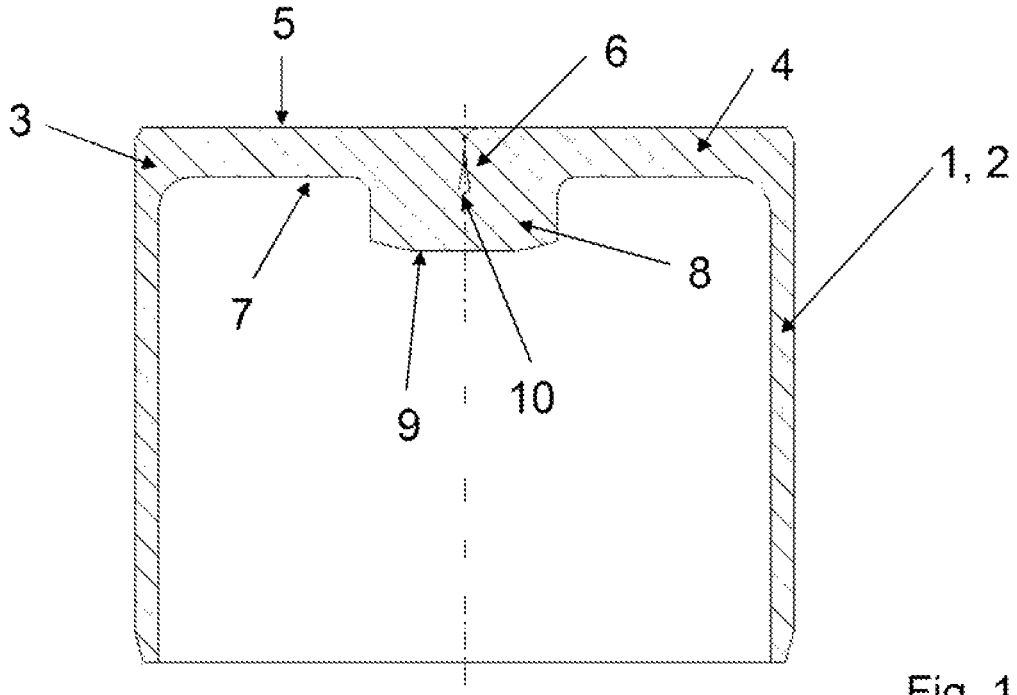
FIG. 1 shows a longitudinal cross-section through a bucket tappet.

FIG. 1 discloses a mechanical bucket tappet 1 for a valve driver of an internal combustion engine. It has a hollow cylinder-shaped wall 2, which is delimited at one frontal area 3 by a disk-like bottom 4. One top side 5 of the bottom 4 serves as cam stop face.

A dome-shaped one-piece catch 8 projects from the lower side 7 of the bottom 4. One end of a valve stem can be put onto the underside 9 of said catch. The extrusion embossing procedure used to manufacture the catch 8, which is generally referred to as "deep-drawing" by experts, "inevitably" results in a funnel-shaped recess 6 at the top side 5 of the bottom 4. The scope of said recess is dependent upon the thickness of the bottom 4 and the height as well as the diameter of the catch 8 to be generated. Normally, said catch 8 is mass-produced with different height increments.

Figure 2:
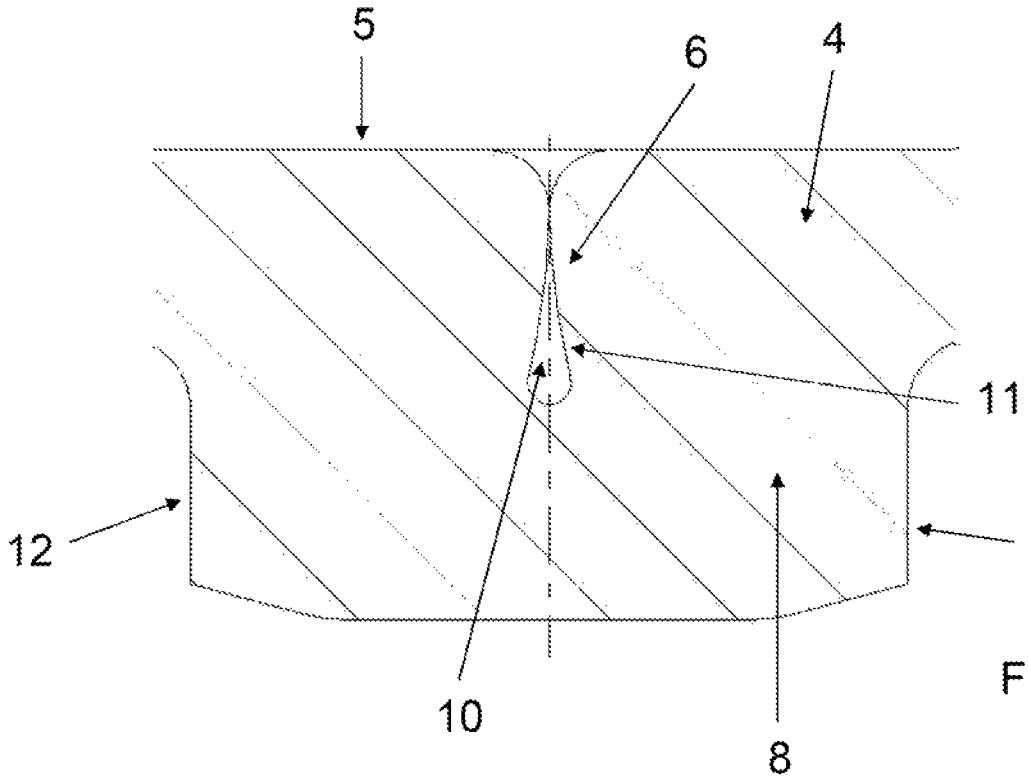
FIG. 2 shows an enlarged view of the catch area of the bucket tappet according to FIG. 1.

As is also illustrated in more detail in FIG. 2, the recess 6 is sealed near the top side 5 of the bottom 4 by means of necking applied to its inner wall 11. This is achieved with a forming clamp applied to the exterior shell 12 of the catch 8, resulting in a central encasement 10 in the bottom 4. If necessary, the recess 6 can also at least nearly completely be eliminated with the retroactive application of the forming tool.

No extremely time-consuming removal of grinding or polishing and other residues from the recess 6 prior to a coating procedure of the top side 5 with a wear protection coat (e.g. PVD/CVD) is required thanks to the seal of the recess 6 near the top side 5 of the bottom 4. It may be possible that contaminations cannot be removed completely without the seal according to the invention.

REFERENCE LIST

1 Bucket tappet
2 Wall
3 Frontal area
4 Bottom
5 Top side
6 Recess
7 Lower side
8 Catch
9 Underside
10 Encasement
11 Inner wall
12 Exterior shell

What we claim is:

1. Mechanical bucket tappet (1) for a valve driver of an internal combustion engine having a hollow cylinder-shaped wall (2) which is delimited at one frontal area (3) by a disk-shaped bottom (4) whose top side (5) is provided as a cam stop face and which comprises a central, funnel-shaped recess (6), wherein a dome-shaped one-piece catch (8) aligned with the recess (6) projects from a lower side (7) of the bottom (4), the underside (9) of said catch being used for putting on a valve stem, characterized in that the funnel-shaped recess (6) is sealed near or at the top side (5) of the bottom (4), so that the bottom (4) comprises a central encasement (10) and characterized in that the seal of the recess (6) is represented with a neck-shaped construction of its inner wall (11).

2. Bucket tappet according to claim 1, characterized in that the seal of the recess (6) is represented with a separate plug.

3. Method for the manufacture of a bucket tappet according to the characteristics of the preamble of claim 1, characterized in that based on the representation of the essential outline of the bucket tappet (1) with wall (2) and bottom (4), the dome-shaped catch (8) is created by means of an extrusion embossing procedure, wherein the funnel-shaped recess (6) resulting in the top side (5) of the bottom (4) is subsequently sealed near or at the top side (5) of the bottom (4) with a least one forming clamp applied to the exterior shell (12) of the dome-like catch (8), so that the bottom (4) comprises a central encasement (10).

* * * * *